US005758992A

United States Patent [19]

Sawallisch

[11] Patent Number: 5,758,992

[45] Date of Patent: Jun. 2, 1998

[54] GOLF BALL ELEVATOR

[76] Inventor: Otto A. Sawallisch, 13478 S. Redberry Cir., Plainfield, Ill. 60544

[21] Appl. No.: 723,687

[22] Filed: Sep. 30, 1996

[51] Int. Cl.[6] ..... B65G 51/02

[52] U.S. Cl. ..... 406/151; 406/171

[58] Field of Search ..... 406/151, 152, 406/153, 165, 171, 172

[56] References Cited

U.S. PATENT DOCUMENTS

| | | | |
|---|---|---|---|
| 3,708,173 | 1/1973 | Hewson, Jr. | 473/153 |
| 3,819,049 | 6/1974 | Koerner et al. | 406/151 X |
| 3,826,439 | 7/1974 | Moon | 473/142 |
| 4,611,809 | 9/1986 | Gettelfinger | 473/161 |
| 5,018,731 | 5/1991 | Doyle | 473/164 |
| 5,029,867 | 7/1991 | Johnson | 473/191 |
| 5,228,168 | 7/1993 | Hollrock et al. | 15/302 |
| 5,332,350 | 7/1994 | Hollrock et al. | 414/376 |

*Primary Examiner*—Andrew C. Pike

*Attorney, Agent, or Firm*—Bullwinkel Partners, Ltd.; Robert W. Gustafson

[57] ABSTRACT

A golf ball elevator includes a tube connected to a suction manifold and elevates golf balls to any desired height. The tube has at least one suction opening in the wall of the tube. The suction manifold covers the suction opening in the tube and draws a partial vacuum in the tube allowing golf balls to travel upwards inside the tube from a lower level to any desired height. At the desired height, the golf balls are released into a container or into another independent location. The golf ball elevator can swivel about its axis to allow the golf balls to be dispensed to surrounding locations. The golf ball elevator can also be connected to a conventional golf ball washer and dryer.

13 Claims, 2 Drawing Sheets

GOLF BALL ELEVATOR

BACKGROUND OF THE INVENTION

1. Field of the Invention

This invention relates to systems for handling and transporting loose golf balls and more particularly to a system for collecting loose golf balls and elevating them to a useful height for sorting, packaging, or other similar purposes.

2. Description of the Prior Art

Systems for handling loose golf balls are becoming more important as golf courses and driving ranges become more popular. Patents involving systems for transporting and handling golf balls generally describe systems which employ the assistance of gravity to effectuate the transport of the golf balls. Among these are: U.S. Pat. No. 4,611,809 issued Sep. 16, 1986, to I. Gettelfinger for a Golf Putting Practice apparatus and U.S. Pat. No. 5,018,731 issued May 28, 1991, to K. A. Doyle for a Golf Ball Driving Practice Apparatus. Other patents involving systems for transporting golf balls employ some type of air pressure. Among these are: U.S. Pat. No. 3,708,173 issued Jan. 2, 1973, to G. J. Hewson, Jr. for a Golf Game, U.S. Pat. No. 5,228,168 issued Jul. 20, 1993, to R. H. Hollrock et al. for a Golf Ball Handling System and U.S. Pat. No. 5,332,350 issued Jul. 26, 1994, to R. H. Hollrock et. al. for a Golf Ball Handling System.

In the prior art, the Hewson patent employs negative pressure to draw golf balls along a pipe, however; gravity is still employed to assist in the transport of the golf balls. Thus, transporting golf balls to a higher elevation is still a problem.

The Hollrock patents describe a golf ball transport mechanism which employs "air moving means", preferably a blower, to transport golf balls to a higher elevation from a golf ball washer to a dispenser. The golf ball transport mechanism described in these patents serves not only to transport the balls but also to dry them. However, the 1993 Hollrock patent recognizes a problem with the use of a blower to move the balls to a higher elevation, that problem being the tendency of the golf balls to "float momentarily" at the end of the conduit while the air flow equalizes around the ball, resulting in a failure of the ball to move upwardly in the conduit immediately. This "floating" problem would presumably lead to clogging as more golf balls continue to feed into the conduit for transport. To avoid this problem, the Hollrock patent uses a golf ball retaining ramp at the base of the conduit prior to the ball's ascent up the conduit, in addition to a liner inside the conduit.

The present invention solves many of these problems by employing negative pressure in a tube to draw golf balls up to a desired height by the use of simple components without requiring any additional features to combat the problems encountered with the use of the positive pressure of the blower.

SUMMARY OF THE INVENTION

The present invention is a golf ball elevator comprising a means for transporting golf balls from a lower level to a higher level, preferably a tube, and a means for creating a partial vacuum in the higher level of the means for transporting, preferably a suction manifold. The tube has a suction opening, or preferably a suction slot, small enough so that a golf ball will not pass through it. The tube is dimensioned having an inside diameter at least large enough to permit a golf ball to freely pass, but preferably just large enough to permit a golf ball to freely pass. The suction manifold is physically connected to the tube so that the suction manifold covers the suction opening. A suction source attached to the suction manifold draws a vacuum, thereby allowing golf balls to travel up through the tube to any desired height. At the desired height, the balls are released from the tube and can be deposited into a container or to an independent location. The tube may be connected to a golf ball dryer which in turn is connected to a golf ball washer.

Thus, it is a principal object of this invention to provide a simple and reliable means for elevating golf balls to a useful height.

Another object of the invention is to provide a golf ball elevator which can transport golf balls away from associated golf ball washers and dryers.

Another object of the invention is to provide a golf ball elevator which can deposit the golf balls into a container or other independent location at the desired height.

Another object of the invention is to provide a golf ball elevator which can swivel about its axis in order to deposit golf balls in a variety of locations.

DETAILED DESCRIPTION OF THE DRAWINGS

Figure 1:
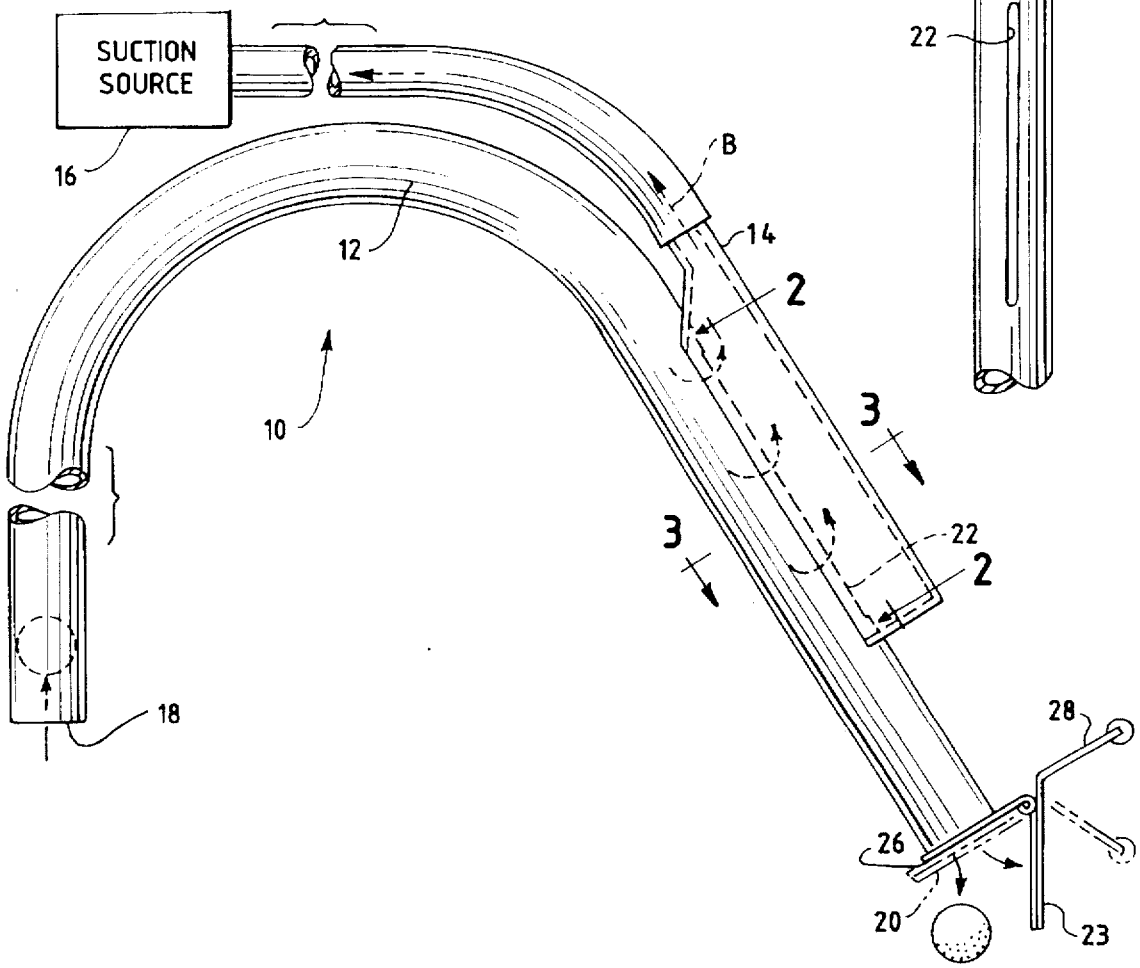
FIG. 1 is a side view of the golf ball elevator showing the golf ball traveling in the tube and exiting through the outlet.
Figure 4:
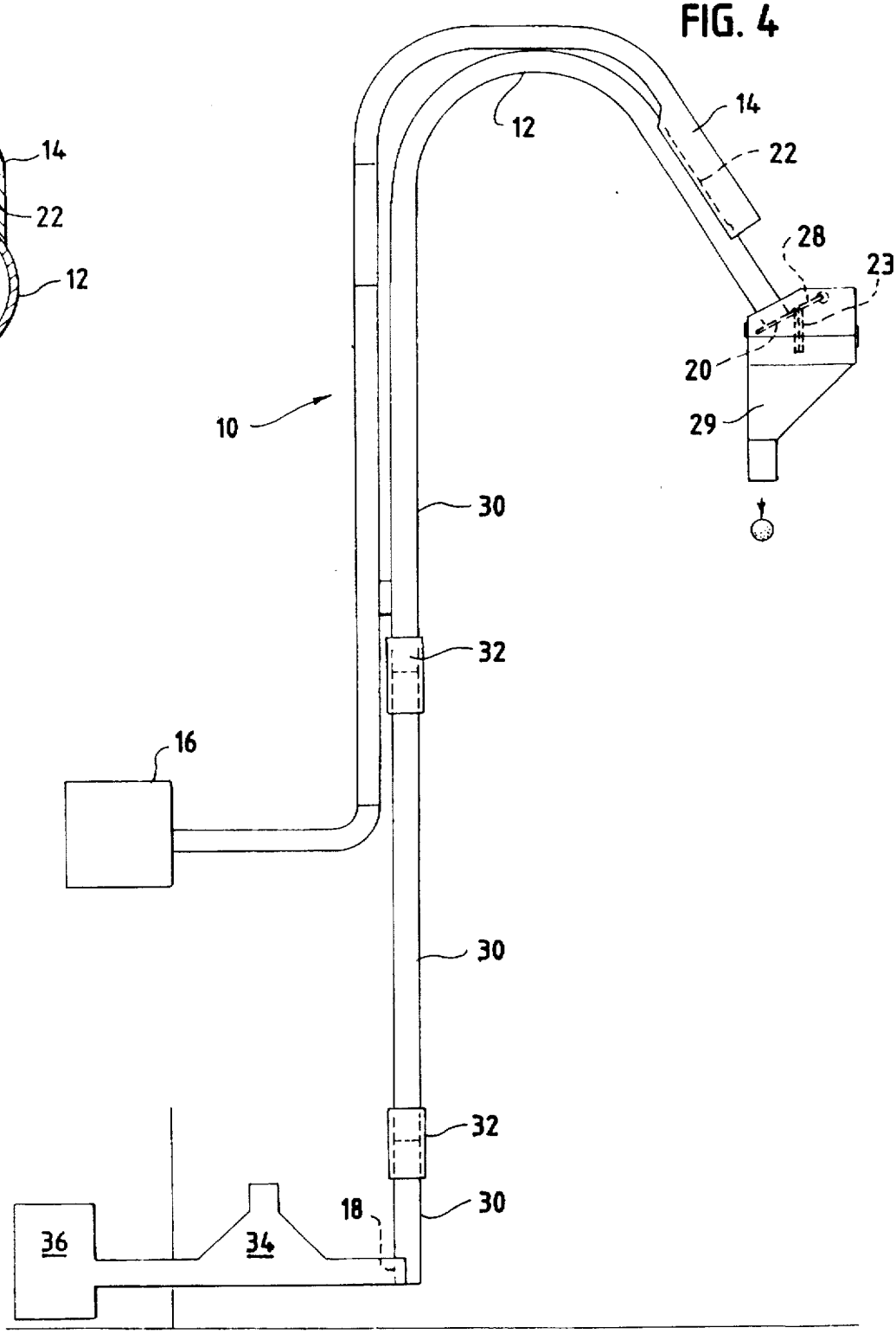
FIG. 4 is a side perspective view of the golf ball elevator showing a container and couplings.

Turning to the drawings, there is shown in FIG. 1 and FIG. 4 a golf ball elevator 10 according to the present invention. The golf ball elevator 10 comprises a tube 12 and a suction manifold 14 connected to the tube 12. The inside diameter of the tube 12 must be large enough to permit a golf ball to pass freely in the tube 12 without obstruction. The tube 12 can be of whatever length necessary to reach the source of the golf balls. The tube 12 and the suction manifold 14 can be made of any sturdy material such as stainless steel, carbon steel, or a plastic material such as PVC (polyvinyl chloride). The suction manifold 14 is connected to a suction source 16 which serves as the source of suction for the golf ball elevator 10.

As shown in FIG. 1, the tube 12 has an inlet 18 which is usually directed upwardly so that the suction drawn by the suction source 16 can reach golf balls at the inlet 18. The tube also has an outlet 20 which is usually directed downwardly so that gravity can help deliver the golf balls out of the tube 12.

The tube 12 contains at least one suction opening 22 in the wall of the tube 12. The suction opening 22 in tube 12 is spaced between the inlet 18 and the outlet 20.

Figure 2:
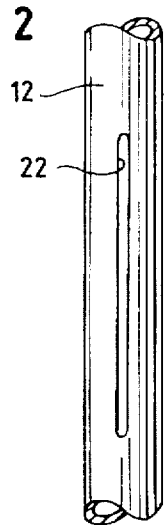
FIG. 2 shows the suction opening in the tube as a lengthwise slot.

As shown in FIG. 2, the preferred embodiment of the suction opening 22 is a lengthwise slot of sufficient width so that the suction can pull golf balls up through the tube 12, but not so large as to allow a golf ball to pass through into the suction manifold 14. In addition, the length of the lengthwise slot must be long enough so as not to clog with multiple balls, cutting off the suction. Preferably, the lengthwise slot is 25.40 centimeters long by 0.64 centimeters wide (ten inches long by one-quarter inch wide).

Although the suction opening 22 is preferably a lengthwise slot, this invention contemplates the use of a number of possibilities for the format of the suction opening 22. These possibilities include, but are not limited to, multiple circular, or other shaped, openings, a large opening covered by a screen or other mesh-like material, and a curved slot. Further designs are readily apparent to one skilled in the art.

As shown in FIG. 1, the suction manifold 14 is spaced between the suction source 16 and the tube 12. When the invention is in operation, the suction source 16 draws suction through the suction manifold 14 in the direction of arrow B. The suction manifold 14 and the tube 12 are connected by welding them together or some other suitable means of physical attachment. The suction source 16 communicates with the suction opening 22 through the suction manifold 14.

Figure 3:
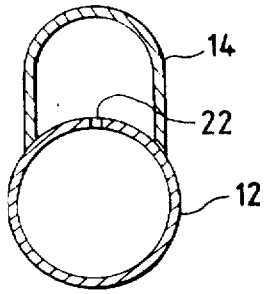
FIG. 3 is a cross-sectional view of FIG. 1 taken along line 3—3.

FIG. 3 shows a cross-sectional view of FIG. 1 taken along line 3—3. At the point of attachment to the tube 12, the suction manifold 14 is preferably semicylindrical and covers the suction opening 22, although other designs are contemplated by the invention. The suction drawn through the suction manifold 14 serves to draw golf balls through the tube 12.

As shown in FIG. 1, the outlet 20 is closed off to the outside by a door flap 23 which seals the tube 12 off from outside air and maintains suction in the tube 12. The door flap 23 is connected to the outlet 20 by a hinge or by some other suitable connecting means. Seal 26 may be connected to the tube 12 between the outlet 20 and the door flap 23. Preferably, the seal 26 is 0.32 centimeters thick (one-eighth inch) and is made of Neoprene or some other suitable flexible, sealing material. The door flap 23 may have a counterweight 28. The door flap 23 opens outwardly away from the tube 12 when the weight of a golf ball sits against it thereby forcing the door flap 23 open.

FIG. 1 shows the door flap 23 in the open position, the golf ball having just exited through the outlet 20. FIG. 1 also shows the door flap 23 with dotted lines in the closed position.

As shown in FIG. 4, a container 29 is optionally connected to tube 12 at the outlet 20 into which the golf balls may be deposited after exiting through the outlet 20. The tube 12 may be comprised of a plurality of subsections 30. In certain circumstances, it may be desirable to swivel the subsections 30 about their axes in order for the golf ball elevator 10 to dispense the golf balls at any desired location. To achieve this goal, the subsections 30 are connected together by a means for swiveling 32 the subsections 30 about their axes such as a slip joint.

Optionally, inlet 18 of the tube 12 can be positioned to communicate with a conventional golf ball dryer 34 which may also be connected to a conventional golf ball washer 36. With this set up, the golf balls can feed from the driving range or other field directly into the golf ball washer 36 then to the golf ball dryer 34 and then through inlet 18 and into tube 12 so that clean golf balls are dispensed through outlet 20.

As shown in FIG. 4, golf balls gathered from a driving range or other field, or the golf ball dryer 34, at a lower level enter the tube 12 through the inlet 18 and are drawn through the tube 12 by vacuum toward the suction opening 22, through the tube 12, past the suction opening 22 without being caught therein, and finally by gravity through the outlet 20 by forcing the door flap 23 open by the weight of the golf ball. After the golf ball exits the tube 12, the door flap 23 returns to a closed and sealed condition and the flow of suction is restored within the tube 12. The door flap 23 returns to a closed and sealed condition by means of the hinge and counterweight 28, or some other door closing means. After exiting the tube 12, the golf balls may be deposited into a container 29 connected to the tube 12. The container 29 or any other suitable dispensing means may serve to dispense the golf balls from the desired height. Alternatively, the golf balls may be deposited into an independent location such as a bucket or PVC pipe trough or any other suitable container.

I claim as my invention:

1. A golf ball elevator comprising:

a tube having an inside diameter large enough to permit a golf ball to freely pass, the tube having an inlet; an outlet, and at least one suction opening spaced between the inlet and the outlet, the outlet being closed by a door flap; and a suction source communicating with the suction opening such that the golf ball is drawn by vacuum toward the suction opening from the inlet, through the tube, past the suction opening without being caught therein, and the golf ball then being drawn by gravity to exit the tube through the outlet and past the door flap, the door flap then returning to a closed condition, restoring suction.

2. The golf ball elevator of claim 1 wherein the door flap forms an airtight seal with the outlet.

3. The golf ball elevator of claim 2 wherein a seal is connected to the tube between the outlet and the door flap.

4. The golf ball elevator of claim 3 wherein the door flap has a counterweight.

5. The golf ball elevator of claim 2 wherein the door flap has a counterweight.

6. The golf ball elevator of claim 1 wherein the door flap has a counterweight.

7. The golf ball elevator of claim 1 wherein the suction opening is dimensioned so that the golf ball can not pass through.

8. The golf ball elevator of claim 1 wherein the suction opening in the tube is a lengthwise slot.

9. The golf ball elevator of claim 1 wherein the inlet is in communication with a golf ball dryer.

10. The golf ball elevator of claim 9 wherein the golf ball dryer is in communication with a golf ball washer.

11. The golf ball elevator of claim 1 wherein the tube is connected to a container at the outlet.

12. A golf ball elevator comprising:

a tube having an inside diameter just large enough to permit a golf ball having a weight to freely pass, the tube having an upwardly directed inlet, a downwardly directed outlet, and at least one suction opening spaced between the inlet and the outlet, the suction opening being dimensioned so that the golf ball cannot pass through the suction opening, and the outlet being closed by an outwardly opening air-sealing door flap openable by the weight of the golf ball against the door flap; and a suction source communicating with the suction opening such that the golf ball is drawn by vacuum toward the suction source from the inlet, through the tube, past the suction opening without being caught therein, and then by gravity to exit the tube through the outlet by forcing the door flap open, whereupon the door flap returns to a sealed condition wherein the suction is restored.

13. A golf ball elevator comprising:

a tube having an inside diameter large enough to permit a golf ball to freely pass, the tube having an inlet, an outlet, and at least one suction opening spaced between the inlet and the outlet, the outlet being closed by a door flap;

a suction source communicating with the suction opening such that the golf ball is drawn by vacuum toward the suction opening from the inlet, through the tube, past the suction opening without being caught therein, and the golf ball then being drawn by gravity to exit the tube through the outlet and past the door flap, the door flap then returning to a closed condition, restoring suction;

a golf ball dryer in communication with the inlet;

a golf ball washer in communication with the golf ball dryer; and a container connected to the tube at the outlet.

* * * * *